US006156158A

United States Patent [19]

Kustermann

[11] Patent Number: 6,156,158

[45] Date of Patent: Dec. 5, 2000

[54] METHOD AND APPARATUS FOR DAMPING CONTACT OSCILLATIONS OF ROTATING ROLLS

[75] Inventor: Martin Kustermann, Heidenheim, Germany

[73] Assignee: Voith Sulzer Papiermaschinen GmbH, Heidenheim, Germany

[21] Appl. No.: 08/990,444

[22] Filed: Dec. 15, 1997

[30] Foreign Application Priority Data

Dec. 18, 1996 [DE] Germany ..... 196 52 769

[51] Int. Cl.[7] ..... D21F 11/00; B30B 3/04

[52] U.S. Cl. ..... 162/198; 162/252; 162/361; 100/162 B; 100/170

[58] Field of Search ..... 248/550, 562; 162/272, 361; 101/216; 100/170, 169, 162 B, 219

[56] References Cited

U.S. PATENT DOCUMENTS

| | | | |
|---|---|---|---|
| 2,364,443 | 12/1944 | Hornbostel | 100/170 |
| 4,597,326 | 7/1986 | Kultaranta | 100/50 |
| 4,936,207 | 6/1990 | Niskanen et al. | 100/47 |
| 5,077,997 | 1/1992 | Wolters et al. | 72/8 |
| 5,201,586 | 4/1993 | Zimmermann et al. | 384/247 |
| 5,431,261 | 7/1995 | Olgac | 188/379 |
| 5,961,899 | 10/1999 | Rossetti et al. | 264/40.01 |

FOREIGN PATENT DOCUMENTS

| | | | |
|---|---|---|---|
| 0 819 638 A2 | 6/1997 | European Pat. Off. | B65H 18/26 |
| 29 50 945 A1 | 6/1981 | Germany | A61C 5/02 |
| 36 39 009 C2 | 11/1986 | Germany | F16F 15/02 |
| 42 32 920 A1 | 9/1992 | Germany | F16F 15/10 |
| 196 35 216A1 | 3/1998 | Germany | B65H 18/26 |

*Primary Examiner*—Stanley S. Silverman
*Assistant Examiner*—Robert McBride
*Attorney, Agent, or Firm*—Taylor & Aust, P.C.

[57] ABSTRACT

In a method and apparatus for damping contact oscillations of rotating rolls in a paper machine, but notably in a coater, the rolls being held endways in bearings and at least two rolls forming with each other a nip, the damping is carried out actively, the active stimulation (phase-shifted counteroscillation) acting from outside directly and/or indirectly on at least one bearing point of one of the rolls.

10 Claims, 2 Drawing Sheets

METHOD AND APPARATUS FOR DAMPING CONTACT OSCILLATIONS OF ROTATING ROLLS

BACKGROUND OF THE INVENTION

1. Field of the Invention

The present invention relates to a method and apparatus for damping oscillations of rotating rolls in a paper machine.

2. Description of the Related Art

The web being produced travels in a paper machine across a plurality of rolls. At least one pair of rolls forms a nip through which the web passes, for example, in the press section, in coaters, winders or smoothing presses. Here, the problem of contact oscillations occurs persistently.

The nature of contact oscillations is that the axes of the two nip-forming rolls move during operation relative to each other, thus unintentionally deforming. This problem increases the higher the web velocity (partly over 2,000 m/min) and the wider the web and, hence, the wider the machine with its respective rolls.

At web velocities in excess of 1,000 m/min and with extremely large web widths, which may measure up to 10 meters, the intensity of the oscillations is such that the rolls deform unevenly (polygonally) and wear. In addition, the oscillations result in a degradation in the operation of the machine. In coaters, the length profile quality of the applied coating undergoes adulteration due to the oscillations.

It is known already to dampen roll oscillations or flexures passively. This is done, e.g., by creating a specially configured flow cross section of a pressure space in the stationary central axis of a rotatable wall shell, as taught in German Document No. 2950945.

Known from U.S. Pat. No. 5,431,261 is a method for damping oscillations of a large mass. This method employs an antivibration device with an additional mass, the latter counteracting the mass to be damped.

The German patent application DE 196 35 216 describes a method and a winder, for winding a paper web into a roll, featuring active oscillation damping. The winder includes an antivibration device with an additional damping mass which acts on the rider roll of the paper roll. The antivibration device includes at least one actuator operating hydraulically or pneumatically. The actuator generates phase-shifted oscillations, thereby extensively suppressing the oscillations of the rider roll.

SUMMARY OF THE INVENTION

The present invention provides a method and apparatus capable of reliably eliminating, or at least damping, contact oscillations of nip-forming rolls. An additional mass such as in the prior art is not to be used in this concept.

The inventors recognized that an active damping of the oscillations of coacting, i.e., nip-forming, rolls can be achieved only by active outside stimulation directed at at least one of the bearings of a roll (tending side and/or gear side). The forces being introduced may also act on the journal of the bearing arrangement, outside or within the bearing point. A sensor attached to the bearing point(s) can measure the roll oscillations and forward an active damping command via an actuator.

It is also possible to position the sensor in the machine center.

Employed for active damping are elements that allow an automatic adaptation to varied conditions. This is very important in order to be able to react correctly and swiftly to changing conditions of production (for example, speed) or machine conditions (e.g., aging roll covering with the associated elastic properties).

Surprisingly and unexpectedly it has been found that an active and effective countermeasure is possible on at least one bearing point, despite the oscillation node being situated there.

The counteroscillation is a sinusoidal oscillation. But it may also have a pulse-like square wave oscillation characteristic (rectangular oscillation). The counteroscillation need not act on every amplitude, but only, e.g., on each second, third, or fourth, etc.

The present invention relates to a paper machine which may be either a paper-making machine or an off-line coater.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out illustrate one preferred embodiment of the invention, in one form, and such exemplifications are not to be construed as limiting the scope of the invention in any manner.

DETAILED DESCRIPTION OF THE INVENTION

Figure 1:
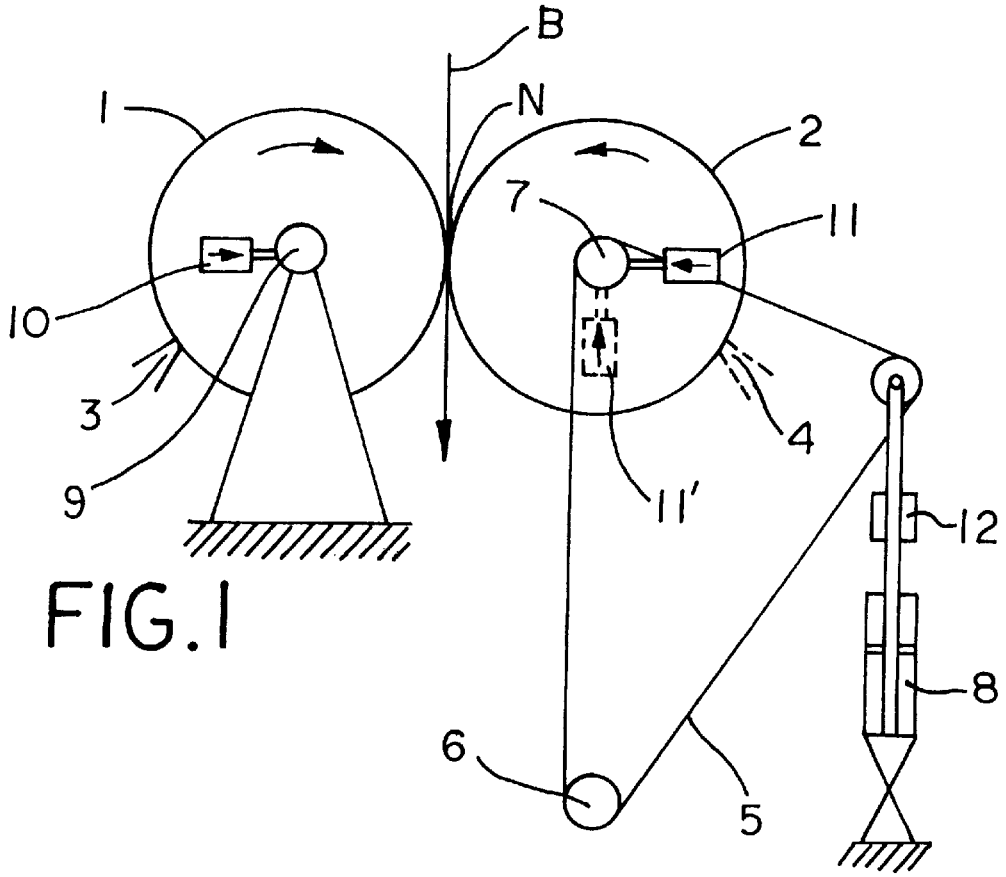
FIG. 1 is a side, schematic view of one embodiment of an apparatus of the present invention.

Referring now to the drawings and particularly to FIG. 1, there is shown schematically two coordinated parallel rolls 1 and 2 of a coater with associated, known applicators 3 and 4 which, however, shall not be explained here in any detail. The web B being coated proceeds between both rolls through the nip N, the direction of web travel being indicated by an arrow.

The two rolls 1 and 2 are illustrated in FIG. 1 horizontally side by side. Naturally, other positioning is also possible. For example, the common plane of their axes of rotation can form an angle with the horizontal. Alternatively, the two rolls 1 and 2 can be arranged vertically one above the other. The travel direction of the web B may also be different.

In the illustrated embodiment, the right-hand roll 2 is mounted in a bearing 7 so as to pivot, by way of pivoting mechanism 5, about a pivot 6 that is parallel to rolls 1 and 2. The pivoting mechanism 5 is operated, e.g., by a power cylinder or pivotal actuator 8.

The roll 1 is mounted fixedly in a bearing 9 and can have an elastic covering of, for example, rubber, polyurethane or similar. The roll 2 either also has an elastic covering or has a steel or chrome-plated shell.

Following from FIG. 1 is the arrangement of inventional actuators 10, 11, 12. Actuator 10 is coupled to the bearing 9 and actuator 11 is coupled to the bearing 7. Actuator 12 introduces a stimulation parallel or serially to the power cylinder 8, the respective displacements of actuator 12 and power cylinder 8 being additive. The actuators counteract the contact oscillations with counterfrequencies. The eigenfrequency of such systems often ranges between 30 and 100 Hz. The three actuators can effect the active damping separately. Also possible are variants, however, wherein actuators 10 and 11 or actuators 10 and 12 act jointly. In the latter case, the working direction of actuator 12 corresponds then, due to the reversal of pivot 6, again to that of actuator 11 (i.e., substantially parallel to the radial connecting line between the axes of rotation 7 and 9 of the nip-forming rolls 2 and 1).

Also possible are other modifications wherein, for example, a second actuator 11' is arranged on the bearing 7 and the working directions of the actuators 11 and 11' impinge on each other substantially perpendicularly.

Figure 2:
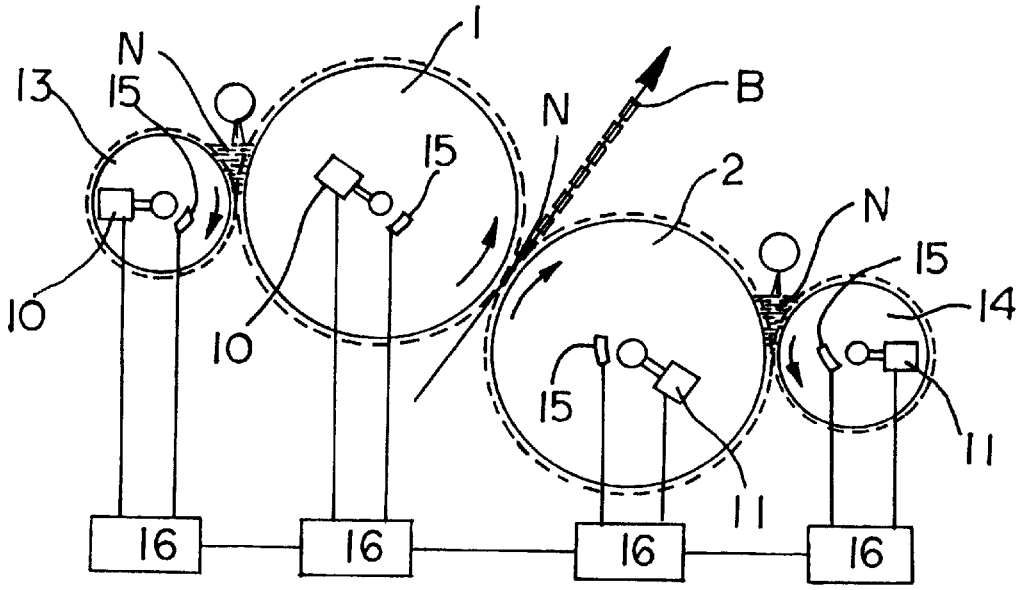
FIG. 2 is a side schematic view of another embodiment of an apparatus of the present invention.

The contact oscillation damping can also be used successfully in a roll arrangement such as shown in FIG. 2.

FIG. 2 shows a two-roll applicator with two applicator rolls 1 and 2 and additional transfer rolls 13 and 14. Rolls 13 and 14 counterrotate relative to the applicator rolls and also form with the latter nips N (filled with liquid).

The material web B proceeds here through the nip N between applicator rolls 1 and 2 in a direction other than in FIG. 1.

The applicator rolls can have substantially identical diameters. The transfer rolls 13 and 14 each have a diameter smaller than that of the applicator rolls. At least one appropriate actuator 10 or 11 can then be employed for vibration damping on at least one bearing of rolls 1, 2, 13 or 14.

Figure 3:
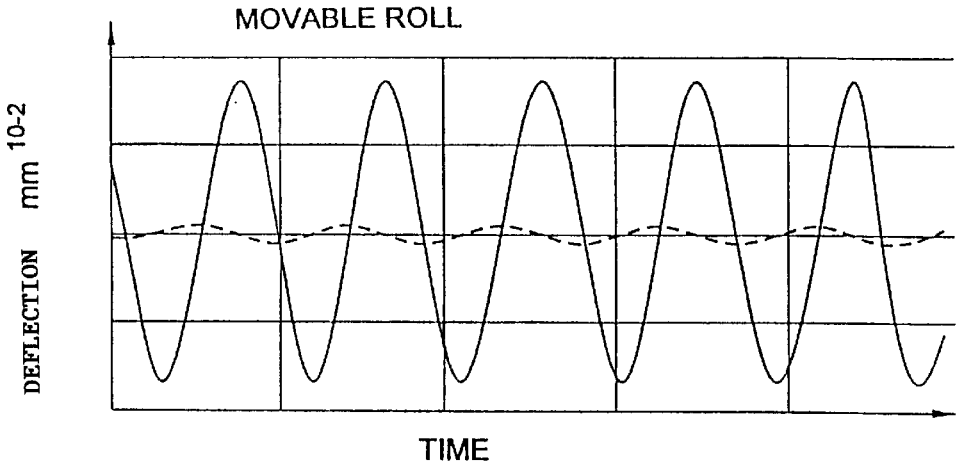
FIG. 3 is a plot of the deflection of an embodiment of a movable roll of the present invention versus time.
Figure 4:
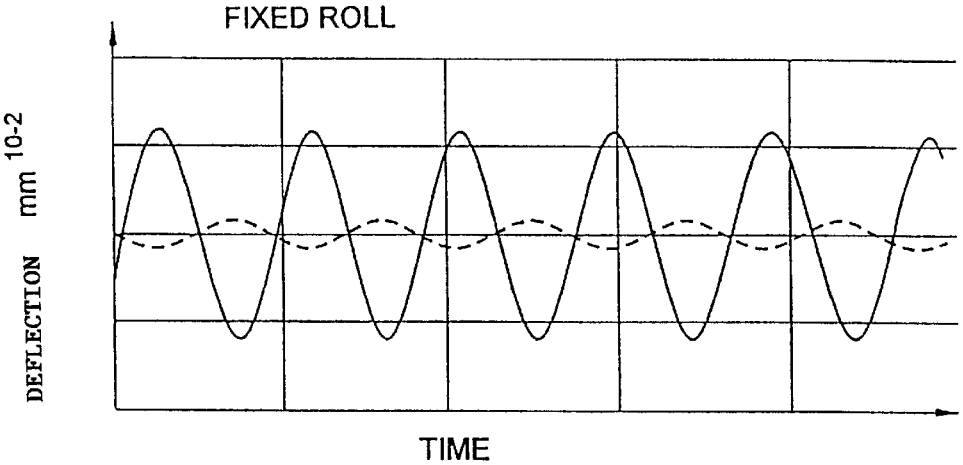
FIG. 4 is a plot of the deflection of an embodiment of a fixed roll of the present invention versus time.
Figure 5:
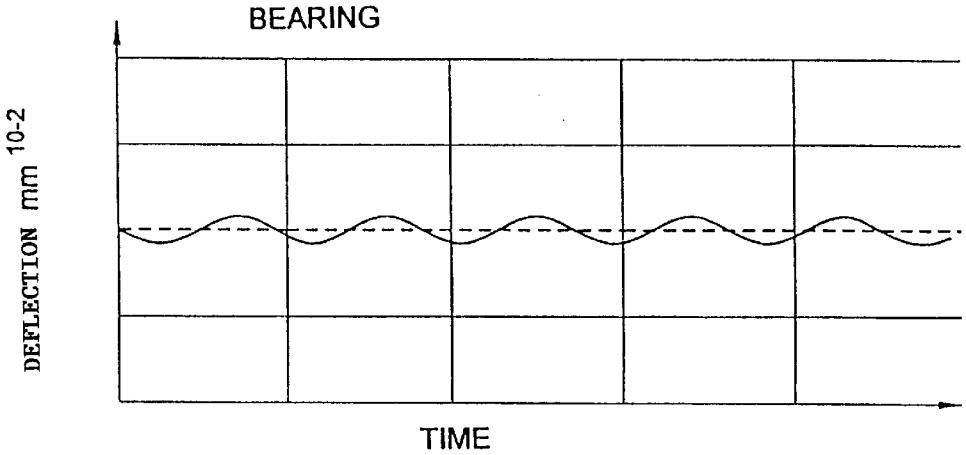
FIG. 5 is a plot of the deflection of an embodiment of the bearings of the present invention versus time.

Examinations in the nip between a movable and a fixed roll showed the following deflections (oscillations), which will be illustrated with the aid of the following FIGS. 3, 4 and 5. The deflection was always determined in the center of rolls 1 and 2, i.e., where the deformation is the greatest with the form of oscillation examined here.

The deflection (oscillation) is plotted on the Y-axis in mm x $10^{-2}$, while on the X-axis the time is plotted in seconds.

FIG. 3 illustrates the deflection of the movable roll 2. The solid curve shows the heavy deflection without active damping. The dashed line shows the now only very weak—approaching nearly zero—deflection with active damping.

FIG. 4 depicts a less heavy deflection in the nip of the fixed roll 1. Here, too, the solid line represents the deflection without oscillation damping, and the dashed line represents the deflection with oscillation damping.

From FIG. 5 it follows that a hardly noticeable deflection occurs in the bearings 7 and 9. As in FIGS. 3 and 4, the deflection is illustrated here also with and without oscillation damping, by dashed and solid lines, respectively.

A controller of the active damping of contact oscillations can operate favorably with the aid of a feedback control system known as such. A sensor 15 detects the actual values of the prevailing roll oscillations. These values are transmitted to a control computer unit 16 for determination of actuating variables for the active damping, based on a comparison of the actual values with preset set values.

Each damping actuator 10 and 11 is associated with a respective sensor 15 and with a respective control computer unit 16. All control computer units 16 are linked in mutual communication.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. In a paper machine, a method for damping oscillations of a plurality of rotating rolls, each of the rolls having two opposite ends, said method comprising the steps of:

holding each of the roll ends in a respective one of a plurality of bearings such that a first roll having a first axis of rotation and a second roll having a second axis of rotation define a nip therebetween;

providing means for moving at least one of said first roll and said second roll in a substantially linear path in a direction substantially perpendicular to a respective said first axis of rotation and said second axis of rotation;

providing means for pivoting at least one of said first roll and said second roll in directions substantially toward and away from said nip; and actively damping the rotating rolls by exerting a phase-shifted counteroscillation on at least one of said bearings using at least one of said moving means and said pivoting means.

2. The method according to claim 1, wherein said phase-shifted counteroscillation is exerted directly on said at least one bearing.

3. The method according to claim 1, wherein said phase-shifted counteroscillation is exerted indirectly on said at least one bearing through said pivoting means.

4. The method according to claim 3, wherein said pivoting means comprises a pivotal actuator producing a first displacement, said actively damping step including the step of using a damping actuator producing a second displacement, said pivotal actuator being connected in series with said damping actuator, said pivotal actuator and said damping actuator producing a total displacement substantially equal to a sum of said first displacement and said second displacement.

5. The method according to claim 1, wherein said counteroscillation is one of a sinusoidal oscillation and a square wave oscillation.

6. The method according to claim 1, wherein said phase-shifted counteroscillation is exerted in a direction of a radial line interconnecting said first axis of rotation and said second axis of rotation.

7. The method according to claim 1, wherein said actively damping step includes the step of using at least one damping actuator, each said damping actuator having a damping frequency represented by the equation:

$$f=1/T$$

wherein:

f=damping frequency, and

T=duration of oscillation; and wherein a frequency of the oscillations to be damped is an integer multiple of each of said damping frequencies.

8. The method according to claim 7, wherein each said at least one damping actuator operates one of thermally, hydraulically, pneumatically, electrically, electromagnetically, magnetically, magnetostrictively and piezoelectrically.

9. The method according to claim 7, wherein said actively damping step comprises the further steps of:

detecting with at least one sensor the oscillations of the rolls;

transmitting signals corresponding to the oscillations to at least one control computer unit; and determining, with said at least one control computer unit, control variables based upon a comparison of said detected oscillations with preset set values.

10. The method according to claim 9, wherein said actively damping step comprises the further steps of associating each said damping actuator with a respective said sensor and with a respective said control computer unit, and configuring said control computer units in mutual communication with each other.

* * * * *

UNITED STATES PATENT AND TRADEMARK OFFICE

CERTIFICATE OF CORRECTION

PATENT NO. : 6,156,158

DATED : December 5, 2000

INVENTOR(S) : Martin Kustermann

It is certified that error appears in the above-identified patent and that said Letters Patent is hereby corrected as shown below:

Abstract

Line 3, delete "being held endways in bearings and at" and substitute --are held endways in bearings. At-- therefor.

Line 4, delete "forming with each other a nip, the" and substitute --form a nip with each other. The-- therefor.

Line 5, after actively delete "," and substitute -- and -- therefor.

Line 6, delete "acting" and substitute --acts-- therefor.

Column 2

Line 37, after set out insert --herein-- therefor.

Column 4

Line 34, after Pivoting means insert --, said exerting steps thereby causing active damping of the rotating rolls.-- therefor.

Column 5

Line 1, after oscillation: Insert a new paragraph therefor.

Signed and Sealed this

Eighth Day of May, 2001

*Attest:*

Nicholas P. Godici

NICHOLAS P. GODICI

*Attesting Officer*

*Acting Director of the United States Patent and Trademark Office*